US007448741B2

(12) United States Patent
von Essen

(10) Patent No.: US 7,448,741 B2
(45) Date of Patent: Nov. 11, 2008

(54) ELONGATED FILTER ASSEMBLY

(75) Inventor: Kevin C. von Essen, San Jose, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 78 days.

(21) Appl. No.: 10/836,456

(22) Filed: Apr. 30, 2004

(65) Prior Publication Data

US 2005/0243145 A1 Nov. 3, 2005

(51) Int. Cl.
*B41J 2/175* (2006.01)
*B41J 2/18* (2006.01)

(52) U.S. Cl. ..... 347/93; 347/85; 347/89

(58) Field of Classification Search ..... 347/93, 347/84; 210/321.75, 321.72
See application file for complete search history.

(56) References Cited

U.S. PATENT DOCUMENTS 4,433,341 A 2/1984 Thomas
4,527,175 A 7/1985 Kojima et al.
4,661,458 A * 4/1987 Berry et al. ..... 435/401
4,680,696 A 7/1987 Eminuma et al.
4,929,963 A 5/1990 Balazar
5,265,315 A 11/1993 Hoisington et al.
5,489,930 A * 2/1996 Anderson ..... 347/71
5,546,109 A 8/1996 Nakano
5,610,645 A * 3/1997 Moore et al. ..... 347/93
5,724,082 A 3/1998 Moynihan
5,751,300 A 5/1998 Cowger et al.
5,782,184 A 7/1998 Albertalli et al.
5,831,654 A 11/1998 Colombat et al.
5,885,455 A * 3/1999 Graus et al. ..... 210/445
5,936,650 A 8/1999 Ouchida et al.
6,000,792 A * 12/1999 Koizumi et al. ..... 347/89
6,084,618 A 7/2000 Baker et al.
6,152,559 A 11/2000 Kojima et al.
6,217,164 B1 * 4/2001 Hino ..... 347/85
6,391,193 B1 * 5/2002 Luka ..... 210/130
6,406,137 B1 * 6/2002 Okazaki et al. ..... 347/93

(Continued)

FOREIGN PATENT DOCUMENTS

EP 0 383 558 8/1990

(Continued)

OTHER PUBLICATIONS

International Search Report and Written Opinion of the International Searching Authority, PCT Application Serial No. PCT/US2005/014370, Apr. 6, 2006, 13 pp.

*Primary Examiner*—Matthew Luu
*Assistant Examiner*—Shelby Fidler
(74) *Attorney, Agent, or Firm*—Fish & Richardson P.C.

(57) ABSTRACT

Systems and techniques are described relating to a filter assembly. In one embodiment, an ink filter assembly includes an inlet channel configured to direct a flow of ink toward an elongated chamber, and an outlet channel configured to direct the flow of ink from an elongated chamber to an ink nozzle assembly. An elongated chamber extends from the inlet channel to the outlet channel, and a membrane provides a permeable separator between an upper section of the elongated chamber and a lower section of the elongated chamber. The membrane is orientated approximately parallel to a longitudinal axis of the elongated chamber and the flow of ink passes through the membrane.

18 Claims, 4 Drawing Sheets

U.S. PATENT DOCUMENTS

| | | | | |
|---|---|---|---|---|
| 6,428,141 | B1 | 8/2002 | McElfresh et al. | |
| 6,467,874 | B1 | 10/2002 | Williams et al. | |
| 6,499,823 | B2 * | 12/2002 | Okazaki et al. | 347/20 |
| 6,634,742 | B2 * | 10/2003 | Owaki et al. | 347/93 |
| 6,652,083 | B2 * | 11/2003 | Ison et al. | 347/93 |
| 6,655,786 | B1 | 12/2003 | Foote et al. | |
| 6,672,706 | B2 | 1/2004 | Silverbrook | |
| 6,672,707 | B2 | 1/2004 | Silverbrook | |
| 6,685,299 | B2 * | 2/2004 | Hirota | 347/20 |
| 6,715,863 | B2 | 4/2004 | Shimizu | |
| 6,752,493 | B2 | 6/2004 | Dowell et al. | |
| 6,796,630 | B2 | 9/2004 | Ison et al. | |
| 6,869,167 | B2 | 3/2005 | Silverbrook | |
| 2002/0024554 | A1 | 2/2002 | Tominaga | |
| 2002/0180827 | A1 | 12/2002 | Hirota | |
| 2003/0227516 | A1 | 12/2003 | Yamaguchi et al. | |
| 2003/0234845 | A1 | 12/2003 | Tominaga et al. | |

FOREIGN PATENT DOCUMENTS

| | | |
|---|---|---|
| EP | 0666177 | 8/1995 |
| EP | 1186416 | 3/2002 |
| EP | 1 336 486 | 8/2003 |
| JP | 07017050 | 1/1995 |

* cited by examiner

ELONGATED FILTER ASSEMBLY

BACKGROUND

The following description relates to a filter assembly.

An ink jet printer typically includes an ink path from an ink supply to an ink nozzle assembly including nozzle openings from which ink drops are ejected. Ink drop ejection can be controlled by pressurizing ink in the ink path with an actuator, which may be, for example, a piezoelectric deflector, a thermal bubble jet generator, or an electrostatically deflected element. A typical printhead has an array of ink paths with corresponding nozzle openings and associated actuators, and drop ejection from each nozzle opening can be independently controlled. In a so-called "drop-on-demand" printhead, each actuator is fired to selectively eject a drop at a specific pixel location of an image, as the printhead and a printing media are moved relative to one another. In high performance printheads, the nozzle openings typically have a diameter of 50 microns or less (e.g., 25 microns), are separated at a pitch of 100-300 nozzles per inch, have a resolution of 100 to 3000 dpi or more, and provide drop sizes of approximately 1 to 70 picoliters (pl) or less. Drop ejection frequency is typically 10 kHz or more.

A printhead can include a semiconductor printhead body and a piezoelectric actuator, for example, the printhead described in Hoisington et al., U.S. Pat. No. 5,265,315. The printhead body can be made of silicon, which is etched to define ink chambers. Nozzle openings can be defined by a separate nozzle plate that is attached to the silicon body. The piezoelectroic actuator can have a layer of piezoelectric material that changes geometry, or bends, in response to an applied voltage. The bending of the piezoelectric layer pressurizes ink in a pumping chamber located along the ink path.

Printing accuracy can be influenced by a number of factors, including the size, velocity and uniformity of ink drops ejected by the nozzles in the printhead and among the multiple printheads in a printer. The drop size and drop velocity uniformity are in turn influenced by factors, such as the dimensional uniformity of the ink paths, acoustic interference effects, contamination in the ink flow paths, and the actuation uniformity of the actuators. Contamination in the ink flow can be reduced with the use of one or more filters in the ink flow path. Typically, a filter is included upstream of the ink chambers, at an interface of an ink reservoir and the printhead, if the reservoir is removable, or is included within or at the reservoir.

In some applications, the ink is recirculated from the ink source to the printhead and back to the ink source, for example, to prevent coagulation of the ink and/or to maintain the ink at a certain temperature above the ambient temperature, for example, by using a heated ink source.

SUMMARY

The following description relates to a filter assembly. In general, in one aspect, the invention features an ink filter assembly including an inlet channel configured to direct a flow of ink toward an elongated chamber, and an outlet channel configured to direct the flow of ink from an elongated chamber to an ink nozzle assembly. The ink filter assembly further includes an elongated chamber extending from the inlet channel to the outlet channel, and a membrane providing a permeable separator between an upper section of the elongated chamber and a lower section of the elongated chamber. The membrane is orientated approximately parallel to a longitudinal axis of the elongated chamber and the flow of ink passes through the membrane.

Embodiments of the invention may include one or more of the following. The ink filter assembly can further include a second inlet channel, a second outlet channel and a second elongated chamber. The second inlet channel is configured to direct a second flow of ink toward the second elongated chamber. The second outlet channel is configured to direct the second flow of ink from the second elongated chamber to the ink nozzle assembly. The second elongated chamber extends from the second inlet channel to the second outlet channel. A second membrane can provide a permeable separator between an upper section of the second elongated chamber, and a lower section of the second elongated chamber. The second membrane can be orientated approximately parallel to a longitudinal axis of the second elongated chamber and the second flow of ink passes through the second membrane. The second membrane can be the same membrane as the membrane referred to above.

In general, in another aspect, the invention features an ink filter assembly including an upper portion, a lower portion and a membrane. The upper portion includes an inlet channel configured to direct a flow of ink toward an elongated chamber, and an upper section of an elongated chamber extending from the inlet channel to an outlet channel. The lower portion includes an outlet channel configured to receive a flow of ink from the elongated chamber and to direct the flow of ink toward an ink nozzle assembly, and a lower section of the elongated chamber extending from the inlet channel to the outlet channel. The membrane is positioned between the upper and lower portions of the assembly and orientated approximately parallel to a longitudinal axis of the elongated chamber. The membrane provides a permeable separator between the upper and lower sections of the elongated chamber, and the flow of ink passes through the membrane.

Embodiments of the invention may include one or more of the following. The membrane can be configured to prevent a particle of a predetermined size present in the ink flow from passing from the upper section of the elongated chamber to the lower section of the elongated chamber. Examples of membranes include a polyimide film having a plurality of openings of a predetermined size, an electroformed metal substrate, a chemically etched metal substrate, or a screen mesh. The upper portion can further include a second inlet channel configured to direct a second flow of ink toward a second elongated chamber, and an upper section of a second elongated chamber extending from the second inlet channel to a second outlet channel. The lower portion can further include a second outlet channel configured to receive the second flow of ink from the second elongated chamber and to direct the second flow of ink toward an ink nozzle assembly, and a lower section of the second elongated chamber extending from the second inlet channel to the second outlet channel. The membrane can provide a permeable separator between the upper and lower sections of the second elongated chamber, and be orientated approximately parallel to a longitudinal axis of the second elongated chamber. The second flow of ink passes through the membrane. The membrane can be configured to prevent particles of a predetermined size present in the ink flow and the second ink flow from passing from the upper sections of the elongated chamber and the second elongated chamber to the lower sections of the elongated chamber and the second elongated chamber respectively.

In another embodiment, the upper portion can further include a second outlet channel configured to direct a second flow of ink out of the assembly, and an upper section of a second elongated chamber extending from the second outlet channel to a second inlet channel. The lower portion can further include a second inlet channel configured to receive the second flow of ink from an ink nozzle assembly to direct the second flow of ink toward the second elongated chamber, and a lower section of the second elongated chamber extending from the second outlet channel to the second inlet channel. The membrane can provide a permeable separator between the upper and lower sections of the second elongated chamber, and be orientated approximately parallel to a longitudinal axis of the elongated chamber, where the second flow of ink passes through the membrane.

The membrane can include a first segment that separates the upper and lower sections of the elongated chamber and a second segment that separates the upper and lower sections of the second elongated chamber. The first segment can be configured to prevent a particle of a predetermined size present in the ink flow from passing from the upper section to the lower section of the elongated chamber, and the second segment can be configured to prevent a particle of a second predetermined size present in the second ink flow from passing from the lower section to the upper section of the second elongated chamber.

The inlet channel of the upper portion can align with the second inlet channel of the lower portion, and the membrane can provide an impermeable separator between the inlet channel and the second inlet channel. The second outlet channel of the upper portion can align with the outlet channel of the lower portion, and the membrane can provide an impermeable separator between the second outlet channel and the outlet channel.

The invention can be implemented to realize one or more of the following advantages. An elongated filter assembly provides an elongated filter surface, thereby reducing the pressure drop across the filter, particularly at high printhead flow rates. High pressure drops, which are avoided, can be detrimental to the performance of the printhead. A smaller pressure drop across the filter reduces the likelihood of gas entering the flow of ink, for example, at nozzles located in an ink nozzle assembly downstream of the filter. The elongated filter surface is less likely to become impassable, for example, due to an accumulation of contaminants caught by the filter, because of the large size of the surface area relative to the cross-section of the ink flow entering and exiting the elongated chamber housing the filter.

Details of one or more implementations are set forth in the accompanying drawings and the description below. Other features and advantages may be apparent from the description and drawings, and from the claims.

DRAWING DESCRIPTIONS

These and other aspects will now be described in detail with reference to the following drawings.

Like reference symbols in the various drawings indicate like elements.

DETAILED DESCRIPTION

Figure 1:
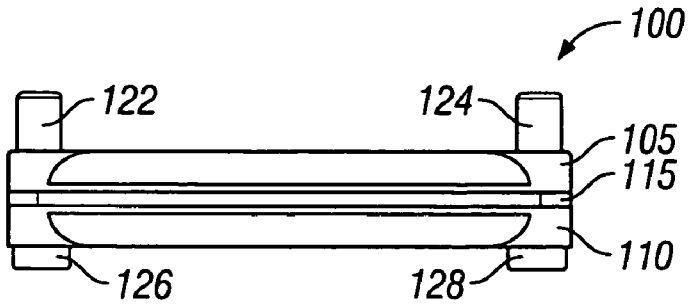
FIG. 1 is a side view of a filter assembly.
Figure 2A:
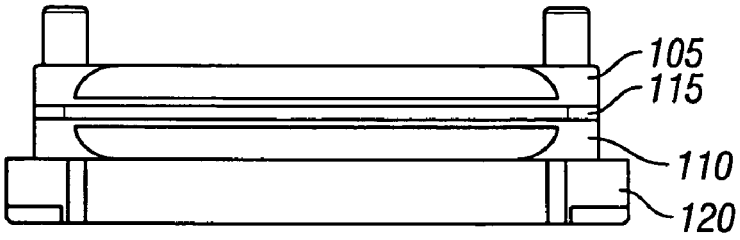
FIG. 2A is a side view of a filter assembly mounted on a printhead housing.
Figure 2B:
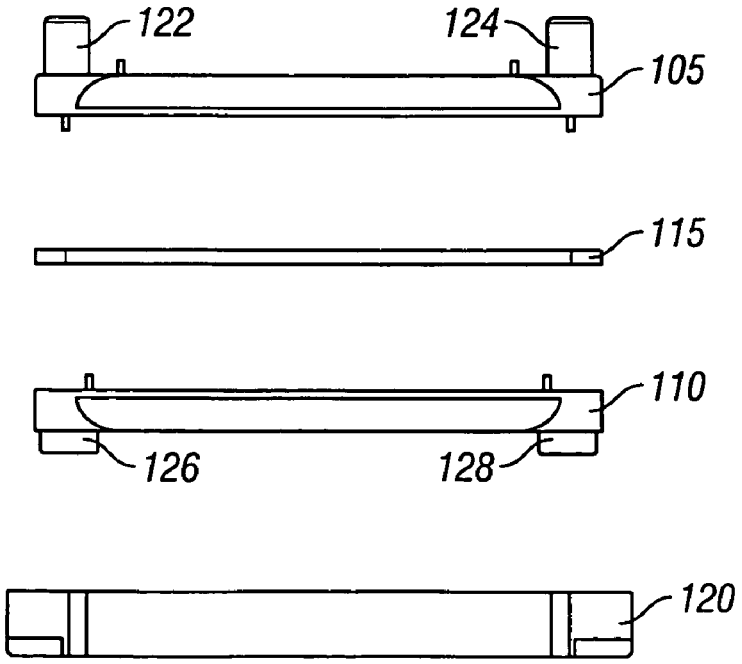
FIG. 2B is an exploded view of the filter assembly and printhead housing of FIG. 2A.

The systems and techniques described here relate to an ink filter assembly. FIG. 1 shows an ink filter assembly 100 including an upper portion 105, lower portion 110 and a thin membrane 115 positioned between the upper portion 105 and the lower portion 110. The filter assembly 100 can be mounted on a printhead housing 120, as shown in FIGS. 2A and 2B. The printhead housing 120 is configured to house a printhead body for ejecting ink drops from an ink nozzle assembly, such as the semiconductor printhead body described in U.S. Provisional Application Ser. No. 60/510,459, entitled "Print Head with Thin Membrane", filed Oct. 10, 2003, the entire contents of which are hereby incorporated by reference.

Each of the upper and lower portions 105, 110 include at least one ink channel. In the embodiment shown in FIG. 1, there are two ink channels 122, 124 in the upper portion 105, and two ink channels 126, 128 in the lower portion 110. An ink channel can function as either an inlet channel or an outlet channel, depending on the direction of ink flow, and whether the ink is recirculating through an ink nozzle assembly in fluid communication with the filter assembly 100.

Figure 3:
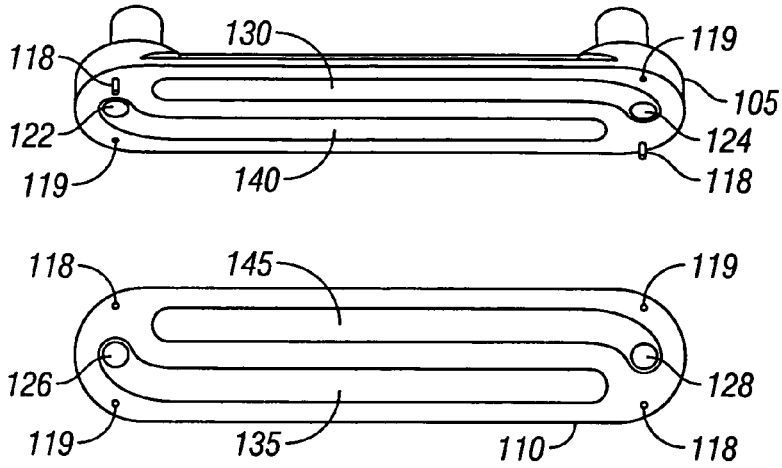
FIG. 3 shows an interior region of the filter assembly of FIG. 1.

FIG. 3 shows a plan view of the lower portion 110 and a tilted side view of the upper portion 105, to illustrate the relationship of the upper and lower portions 105, 110. For illustrative purposes, the membrane 115 is not shown. When the upper and lower portions 105, 110 are assembled as shown in FIG. 1, an interior elongated chamber is formed between the portions 105, 110 for each pair of ink channels (a pair being an ink channel in the upper portion and a corresponding ink channel in the lower portion). That is, in the embodiment shown in FIGS. 1 and 3, there are two pairs of ink channels, and accordingly there are two interior elongated chambers formed between the upper and lower portions 105, 110 when assembled. In one embodiment, an elongated chamber is approximately 4 mm wide and approximately 50 mm long.

Referring to FIG. 3, an upper section of a first elongated chamber 130 is formed in the upper portion 105 of the filter assembly 100, which corresponds with a lower section of the first elongated chamber 135 formed in the lower portion 110 of the filter assembly 100. The first elongated chamber 130-135 forms a first ink path for ink flowing between the ink channel 124 formed in the upper portion 105 and the corresponding ink channel 126 formed on the opposite end of the lower portion 110.

Similarly, an upper section of a second elongated chamber 140 is formed in the upper portion 105, which corresponds with a lower section of the second elongated chamber 145 formed in the lower portion 110. The second elongated chamber 140-145 forms a second ink path for ink flowing between the ink channel 122 formed in the upper portion 105 and the corresponding ink channel 128 formed on the opposite end of the lower portion 110.

A membrane providing a permeable separator between an upper section and a lower section of an elongated chamber formed within the filter assembly 100 can filter ink as ink flows from one end of the elongated chamber to the other. For example, a member 115 can be positioned between the upper and lower portions 105, 110 of the filter assembly 100 as shown in FIG. 1, thereby separating the upper section 130 of the first elongated chamber from the lower section 135, and separating the upper section 140 of the second elongated chamber from the lower section 145. Alternatively, a separate membrane can be used to separate each of the elongated chambers.

The elongated filter, that is, the permeable separator between the upper and lower sections of an elongated chamber, has a relatively large surface area as compared to, for example, a filter placed in a perpendicular configuration to an ink flow, such as at the outlet of an ink source. The larger surface area results in a relatively smaller pressure drop across the filter. By reducing the pressure drop across the filter, gas is less likely to be ingested into nozzles in the ink nozzle assembly downstream of the filter. Reducing gas in the nozzles, and therefore in the ink, improves the print quality. Ingested gas create an air bubble resulting in poor or non-jetting from a nozzle. Reducing the pressure drop across the elongated filter is important, since the control of the printhead internal pressure is also important to the printhead's performance. Because the ink flow rate changes with printing density and speed, preferably the elongated filter has a negligible effect on the printhead's internal pressure through all operating flow rate variations. Additionally, the larger surface area provides for improved filtering of particles (i.e. contaminants), as particles ingested into the ink can be detrimental to the print quality.

As ink flows the length of an elongated chamber, the ink filters through the membrane, thereby removing contaminants from the ink flow. Contaminants can block an ink nozzle opening, slow ink flow and lower the printing quality if not removed from the ink flow upstream of the ink nozzle assembly. The membrane includes a number of openings that are sized such that ink flow is not unnecessarily restricted, but also such that contaminants of at least a certain size are removed from the ink flow. In one embodiment, the membrane can be formed from a polyimide film and openings can be laser cut into the polyimide film in at least the regions that will be used to filter ink (i.e., regions of the film that are not in the ink path, such as regions between the edges of the upper and lower portions, may not include openings).

Figure 4A:
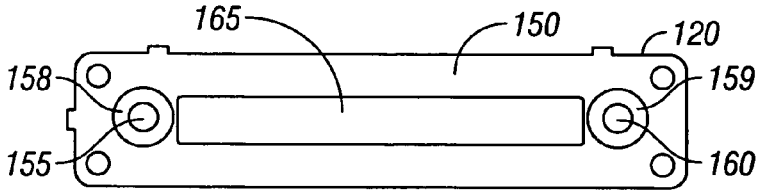
FIG. 4A is a plan view of an upper surface of a printhead housing.
Figure 4B:
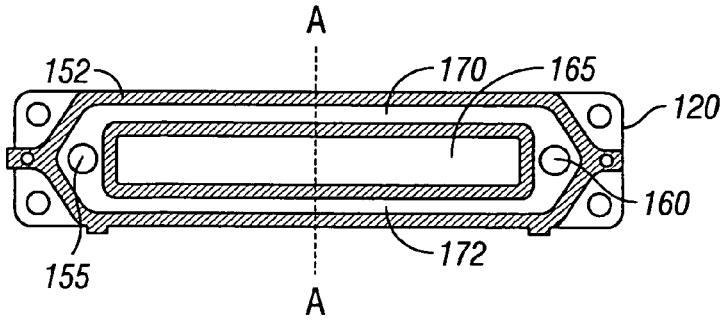
FIG. 4B is a plan view of a lower surface of the printhead housing of FIG. 4A.
Figure 4C:
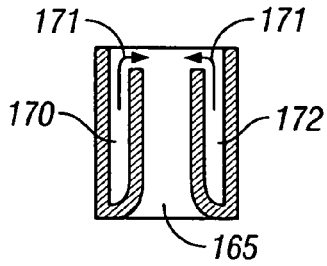
FIG. 4C is a cross-sectional view along line A-A of the printhead housing of FIG. 4B.

Referring to FIGS. 4A-4C, the printhead housing 120 is shown. FIG. 4A shows a plan view of a surface 150 of the printhead housing 120 that mates with the lower portion 110 of the filter assembly 100. An opening to an ink channel 155 aligns with the ink channel 126 formed in the lower portion 110 of the filter assembly 100, and a second opening to a second ink channel 160 aligns with the ink channel 128 formed in the lower portion 110. FIG. 4B shows a plan view of the opposite surface 152 of the printhead housing 120. An opening 165 is configured to house a printhead assembly, for example, a semiconductor printhead, that includes an ink nozzle assembly for injecting ink drops. The ink channels 155 and 160 terminate in channels 170 and 172 formed on either side of the opening 165. A cross-sectional view of the printhead housing 120 taken along line A-A is shown in FIG. 4C, illustrating the channels 170 and 172 formed along the length of the printhead assembly 120. The ink flows along the paths 171 shown from the channels 170, 172 toward and into an ink nozzle assembly within a printhead unit (not shown) that can be mounted within the opening 165.

The upper portion 105 and the lower portion 110 of the filter assembly 100 can be joined together using any convenient means, such as an adhesive or screws. Depending on how the membrane 115 is configured, the upper portion 105 can be adhered to the membrane 115, and the membrane 115 adhered to the lower portion 110, thereby joining the upper and lower portions 105, 110 via the membrane 115. Locator pins and corresponding openings, such as the pins 118 and openings 119 shown in FIG. 3, can be used to position the upper portion 105 relative to the lower portion 110 and to maintain the position, for example, while an adhesive hardens. The adhesive should be selected to be compatible with the ink to be used in the filter assembly 100. For example, certain ultraviolet inks harden upon exposure to ultraviolet light and can be very corrosive. There are certain epoxy formulations that are resistive to such inks, and if a suitable epoxy is not used, the ink can corrode the adhesive and the filter assembly 100 may fall apart.

The lower portion 110 of the filter assembly 100 can be mounted on the printhead housing 120 using any convenient means, such as an adhesive or screws. In one embodiment, as shown in FIGS. 2A, 2B and 4A, the lower portion 110 can include ink channels 126, 128 sized to fit within corresponding recesses 158, 159 formed in the surface 150 of the printhead housing 120 that mates with the lower portion 110. An adhesive can be used to secure the ink channels 126, 128 into the recesses 158, 159, thereby joining the lower portion 110 to the printhead housing 120 and providing a seal to prevent leaking of ink passing between the lower portion 110 and the printhead housing 120. As described above, a suitable adhesive should be selected that is compatible with the ink to be used in the filter assembly 100.

In the embodiment shown in FIGS. 1-3, which includes two pairs of ink channels, there are at least two ink flow patterns; in a first ink flow pattern both ink channels 122, 124 formed in the upper portion 105 operate as ink inlets and both ink channels 126, 128 formed in the lower portion 110 operate as ink outlets. In a second ink flow pattern, one ink channel 124 in the upper portion 105 and one ink channel 128 in the lower portion 110 operate as ink inlets, while the remaining ink channel 122 in the upper portion 105 and ink channel 126 in the lower portion 110 operate as ink outlets. The second ink flow pattern can be a recirculation scheme.

Figure 5A:
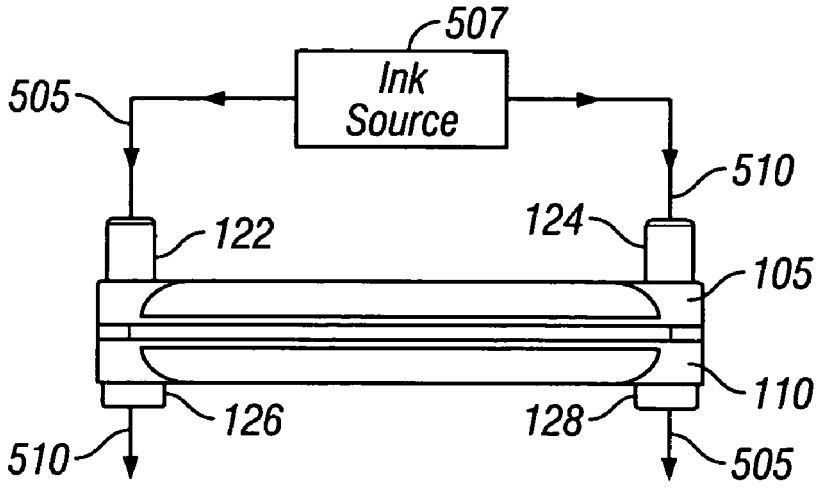
FIG. 5A is a side view of a filter assembly showing two ink flow paths.
Figure 5B:
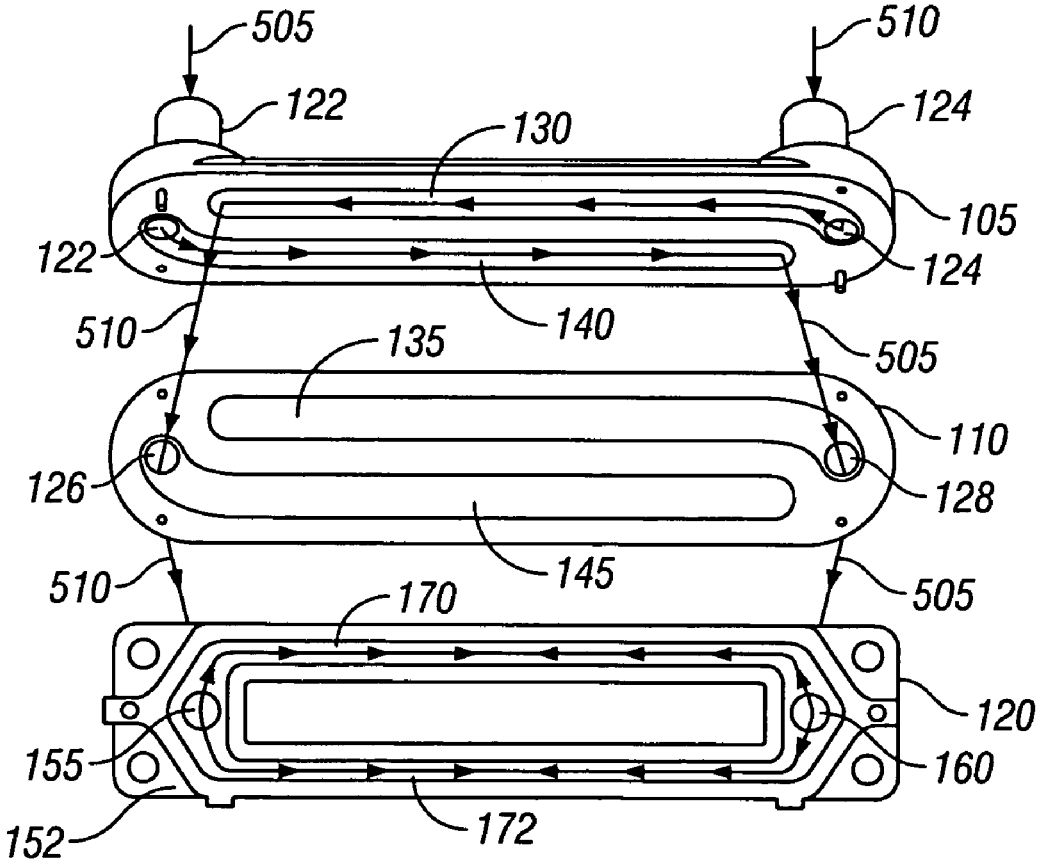
FIG. 5B is an exploded view of a filter assembly and a printhead housing showing two ink flow paths.

Referring to FIGS. 5A-5B, the first ink flow pattern is depicted with reference to a side view of the assembled upper and lower portions 105, 110 in FIG. 5A, and a view of the disassembled upper and lower portions 105, 110 of the filter assembly 100 and the printhead housing 120 in FIG. 5B. There are two ink flows into the upper portion 105 of the filter assembly 110; a first ink flow 505 entering through the ink channel 122 shown on the left, and a second ink flow 510 entering through the ink channel 124 shown on the right, referred to with reference to FIGS. 5A and 5B as the left inlet channel 122 and the right inlet channel 124 respectively. The ink flow initiates at an ink source 507. Alternatively, the ink for the first ink flow 505 can initiate at a first ink source and the ink for the second ink flow 510 can initiate at a different, second ink source.

There are two corresponding ink flows out of the lower portion 110. The first ink flow 505 exits from the lower portion 110 through the ink channel 128 shown on the right, and the second ink flow 510 exits through the ink channel 126 shown on the left, referred to with reference to FIGS. 5A and 5B as the left outlet channel 126 and the right outlet channel 128, respectively.

With respect to the first ink flow 505, the ink enters the left inlet channel 122 from the ink source 507. The ink flows through the left inlet channel 122 and enters the upper section 140 of the second elongated chamber. A membrane (not shown) provides a permeable separator between the upper section 140 and the lower section 145 of the second elongated chamber and filters the ink as the ink flows from left to right along the length of the second elongated chamber. The ink flow 505 is shown as a path in the upper section 140 of the second elongated chamber, however, it should be understood that as the ink filters through the membrane, ink also flows along the lower section 145 of the second elongated chamber, even though a path is not shown. Once the ink reaches the end of the second elongated chamber, the ink flows through the right outlet channel 128 and exits the lower portion 110 of the filter assembly 100.

The ink flow enters an ink channel 160 in the printhead housing 120, which shall be referred to with reference to FIG. 5B as the printhead right inlet channel 160. The ink flows from the printhead right inlet channel 160 along the length of the channels 170 and 172 formed in the lower surface of the printhead housing 120. The channels 170 and 172 are in fluid communication with an ink nozzle assembly forming part of a printhead assembly (not shown), and the ink flows from the channels 170, 172 into the ink nozzle assembly and is ejected onto a printing substrate.

With respect to the second ink flow 510, a similar but opposite path is taken through the filter assembly 100 and the printhead housing 120 as the first ink flow 505. The ink enters the right inlet channel 124 from the ink source 507, or alternatively, from a second ink source (not shown). The ink flows through the right inlet channel 124 and enters the upper section 130 of the first elongated chamber. A membrane (not shown) provides a permeable separator between the upper section 130 and the lower section 135 of the first elongated chamber and filters the ink as the ink flows from right to left along the length of the first elongated chamber. The ink flow 510 is shown as a path in the upper section 130 of the first elongated chamber, however, it should be understood that as the ink filters through the membrane, ink also flows along the lower section 135 of the first elongated chamber, even though a path is not shown.

Once the ink reaches the end of the first elongated chamber, the ink flows through the left outlet channel 126 and exits the lower portion 110 of the filter assembly 100. The ink flow 510 enters an ink channel 155 in the printhead housing 120, which shall be referred to with reference to FIG. 5B as the printhead left inlet channel 155. The ink flows from the printhead left inlet channel 155 along the channels 170 and 172 formed in the lower surface of the printhead housing 120.

The ink flow is generated by the ejection of ink from the ink nozzle assembly. For example, in one embodiment, the printhead can include a semiconductor printhead body and a piezoelectric actuator, which pressurizes ink in a pumping chamber located along the ink path; The ink flow increases as more nozzles eject ink. Minimizing pressure changes due to the varying flow within the printhead is important, since preferably there is no pressure change at an inlet to each nozzle channel from zero flow (i.e., no nozzles ejecting ink) to full flow (i.e., all nozzles ejecting ink). The ink flow can be generated by use of an external pump, for example, for filling, purging, flushing, cleaning or recirculating the ink through the printhead and filter assembly 100.

FIGS. 5A and 5B show a filter assembly 100 configured with two inlet ink flows 505, 510, both directed toward a printhead housing 120 in fluid communication with an ink nozzle assembly. The configuration does not recirculate the ink, and once the ink enters the filter assembly 100 and the ink nozzle assembly, the ink remains there until ejected during an ink jet printing process. This configuration is appropriate in certain applications where the temperature of the ink can be the same as the ambient temperature. Alternatively, the filter assembly 100, the printhead housing 120 and the printhead unit including the ink nozzle assembly can be heated to maintain the ink at a temperature above the ambient temperature, although typically only a few degrees higher than the ambient temperature. In other applications, the ink must be kept moving, so as not to coagulate, and/or must be kept at a temperature significantly above the ambient temperature. In such applications, a recirculation scheme may be more appropriate.

Figure 6A:
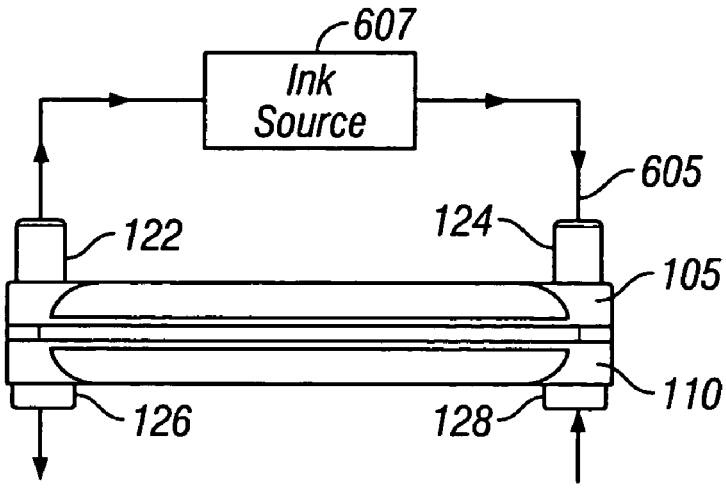
FIG. 6A is a side view of a filter assembly showing a recirculation ink flow path.
Figure 6B:
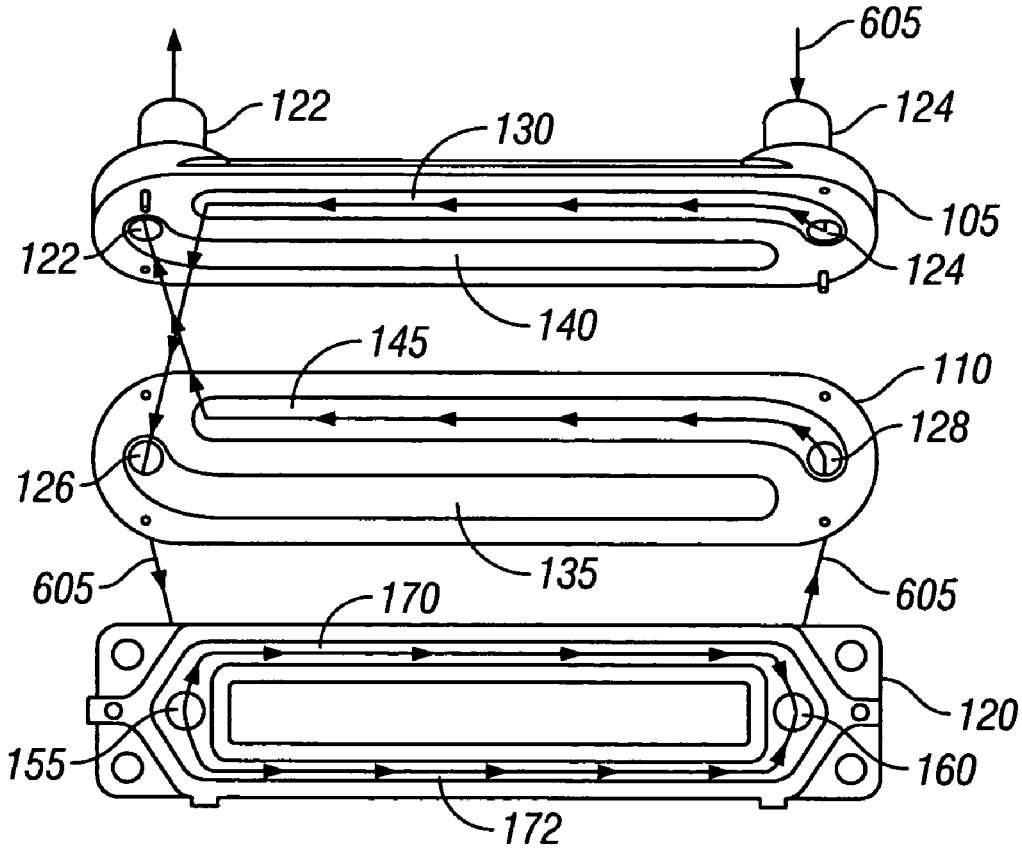
FIG. 6B is an exploded view of a filter assembly and a printhead housing showing a recirculation ink flow path.

FIGS. 6A and 6B show a filter assembly 100 configured with one ink flow 605 entering the filter assembly 100 from an ink source 607 and exiting into the printhead housing 120, which is in fluid communication with an ink nozzle assembly. The ink flows through the printhead housing 120 where some of the ink is consumed by the ink nozzle assembly (i.e., used during an ink jet printing process). The remaining ink flows through the printhead housing 120 and back into the filter assembly 100 and finally exits the filter assembly 100 and returns to the ink source 607.

Referring to FIG. 6B, the ink flow 605 enters the filter assembly 100 from the ink source 607 through the ink channel 124 formed in the upper portion 105. The ink flows through the ink channel 124 into the upper section 130 of the first elongated chamber. As the ink flows from right to left along the length of the first elongated chamber, the ink is filtered through a membrane (not shown) providing a permeable separator between the upper section 130 and the lower section 135 of the first elongated chamber. The ink flow 605 is shown as a path in the upper section 130 of the first elongated chamber, however, it should be understood that as the ink filters through the membrane, ink also flows along the lower section 135 of the first elongated chamber, even though a path is not shown.

Once the ink reaches the end of the first elongated chamber, the ink flows through the ink channel 126 and exits the lower portion 110 of the filter assembly 100. The ink flow 605 enters an ink channel 155 in the printhead housing 120, and flows from the ink channel 155 along the channels 170 and 172 formed in the lower surface of the printhead housing 120. Some of the ink flow 605 enters a printhead unit housed within the printhead housing 120 and is consumed by an ink nozzle assembly therein. The remaining ink flows from the channels 170, 172 toward and into the ink channel 160.

The ink flow 605 exits the printhead housing 120 and enters the lower portion 110 of the filter assembly 100 through the ink channel 128. The ink flows from the ink channel 128 into the lower section 145 of the second elongated chamber. As the ink flow 605 moves right to left along the length of the second elongated chamber, the ink can be filtered by a membrane (not shown) providing a permeable separator between the upper and lower sections 140, 145 of the second elongated chamber. Alternatively, there can be no membrane separating the upper and lower sections 140, 145 of the second elongated chamber as it may not be required or desirable to filter the ink flow 605 as the ink is leaving the filter assembly 100. The ink flow 605 exits the filter assembly 100 through the ink channel 122 formed in the upper portion 105 and returns to the ink source 607.

In another embodiment, if a single membrane is used to separate the upper and lower sections of the both the first and the second elongated chambers, then openings provided in the region of the membrane separating the upper and lower sections 130, 135 of the first elongated chamber can be a different size than openings provided in the region of the membrane separating the upper and lower sections 140, 145 of the second elongated chamber. As such, the ink flow 605 can be filtered to one degree while in route to the printhead housing 120 and to a second degree or not at all (e.g., a lesser degree) while in route back to the ink source 607.

In the embodiment shown in FIGS. 3, 5A, 5B, 6A and 6B, the ink channels 122 and 124 formed in the upper portion 105 align with the ink channels 126 and 128 formed in the lower portion 110. To direct the ink flow along the length of an elongated chamber, rather than directly through an ink channel in the upper portion into an ink channel in the lower portion (or visa-versa), an impermeable separator is positioned to separate each of the ink channels 122, 124 formed in the upper portion 105 from the corresponding ink channels 126, 128 formed in the lower portion 110. In one embodiment, the membrane providing a permeable separator between the upper and lower sections of the elongated chambers can form the impermeable separator between each pair of ink channels. For example, if the membrane is a polyimide film with openings laser cut in the film to provide permeability in some regions, then other regions of the membrane can remain uncut, and therefore impermeable, to separate a pair of ink channels. Alternatively, the ink channels formed in the upper and lower portions 105, 110 of the filter assembly 100 can be configured such that they do not align, thereby eliminating the need for an impermeable separator to be positioned therebetween.

The embodiment of the filter assembly shown in FIGS. 1, 3, 5A-B and 6A-B includes two elongated chambers. However, as stated above, the filter assembly can include a single elongated chamber or more than two elongated chambers.

The membrane forming an impermeable separator between an upper and lower section of an elongated chamber can be formed in any convenient manner. In one embodiment, described above, the membrane is formed from a polyimide film with openings cut into the polyimide film to provide permeability, for example, by laser cutting. A polyimide film, such as Kapton® available from DuPont High Performance Materials of Ohio, can be used, and in one embodiment can be cut to 50% open. The openings can have a diameter size of approximately 10 to 75 microns, as an example. The size of the openings depends on the size of the nozzles included in the ink nozzle assembly. Preferably the openings are smaller than the nozzle diameter to prevent blockage of the nozzles by contaminants in the ink. In another embodiment, the membrane can be a thin, metal substrate perforated in regions intended for filtering, formed by electroforming, for example, using nickel or a nickel alloy. Electroforming can be done with a photo imaged pattern and subsequent additive selective plating to grow the predefined shape with the openings.

In another embodiment, the membrane can a thin, metal substrate, for example, stainless steel, a ferritic stainless steel or ferritic alloy, with openings etched into the metal substrate using a chemical etching process. In yet another embodiment, the membrane can be a screen mesh, for example, stainless steel with 20% open. However, in regions where the membrane must be impermeable, for example, in a region separating an ink channel in the upper portion from an ink channel in the lower portion, the screen mesh must be blocked to prevent permeation of the ink. In one embodiment, a die cut B-stage epoxy adhesive film is used to join the upper portion 105 and lower portion 110 of the filter assembly 100. The adhesive film is die cut such that areas where there can be ink flow are removed. Accordingly, where ink flow is not desired, such as in the region separating an ink channel formed in the upper portion 105 from an ink channel formed in the lower portion 110, the film can function as a barrier. An adhesive film can be used on each side of the filter, to adhere the filter to both the upper and lower portions 105, 110.

The filter assembly and the printhead housing can be formed from any convenient material. A liquid crystal polymer can provide suitable chemical resistance to ink flowing through the filter assembly and has a low thermal expansion coefficient. Ideally, the thermal expansion coefficient for each component in the filter assembly and the printhead housing match, so as to prevent misalignment and the like due to differing thermal expansion properties. As described above, the membrane can be adhered to the filter assembly, for example, using a B-stage epoxy film applied to both sides of the membrane to adhere to both the upper and lower portions of the filter assembly.

The use of terminology such as "upper" and "lower" throughout the specification and claims is for illustrative purposes only, to distinguish between various components of the elongated filter assembly. The use of "upper" and "lower" does not imply a particular orientation of the assembly. For example, the upper section of an elongated chamber can be orientated above, below or beside the lower section of the elongated chamber, and visa versa, depending on whether the elongated filter assembly is positioned horizontally face-up, horizontally face-down or vertically.

Although only a few embodiments have been described in detail above, other modifications are possible. Other embodiments may be within the scope of the following claims.

What is claimed is:

1. A system, comprising:

an ink filter assembly comprising:

a first inlet channel located at a first end of the ink filter assembly and configured to direct a first flow of ink in a first direction toward a first elongated chamber;

a first outlet channel configured to direct the first flow of ink from the first elongated chamber to an ink nozzle assembly;

the first elongated chamber extending from the first inlet channel to the first outlet channel;

a first membrane providing a permeable separator between an upper section of the first elongated chamber and a lower section of the first elongated chamber, where the first membrane is orientated approximately parallel to a longitudinal axis of the first elongated chamber and the first flow of ink passes through the first membrane;

a second inlet channel located at a second opposite end of the ink filter assembly and configured to direct a second flow of ink in a second opposite direction toward a second elongated chamber;

a second outlet channel configured to direct the second flow of ink from the second elongated chamber to the ink nozzle assembly;

the second elongated chamber extending from the second inlet channel to the second outlet channel; and a second membrane providing a permeable separator between an upper section of the second elongated chamber and a lower section of the second elongated chamber, where the second membrane is orientated approximately parallel to a longitudinal axis of the second elongated chamber and the second flow of ink passes through the second membrane;

wherein the ink filter assembly is configured to mount directly to a printhead housing including the ink nozzle assembly, such that the first and second elongated chambers are positioned directly above the printhead housing and the longitudinal axes of the first and second elongated chambers are substantially parallel to a longitudinal axis of the printhead housing and to a row comprising a plurality of nozzles included in the ink nozzle assembly; and the printhead housing including:

an elongated body including a first opening to a first ink channel that aligns with the first outlet channel of the ink filter assembly and a second opening to a second ink channel that aligns with the second outlet channel of the ink filter assembly, the first and second ink channels terminating in at least one housing channel, where the ink filter assembly is mounted directly to the printhead housing and the first and second outlet channels are joined to the printhead housing with a fluid-tight connection;

the at least one housing channel being formed in the elongated body along a length of the elongated body, the at least one the housing channel in fluid communication with the first and second outlet channels of the ink filter assembly via the first and second ink channels respectively, where the at least one housing channel is formed between an outer wall and an inner wall of the printhead housing, and the inner wall is configured to allow ink to flow between the at least one housing channel and an elongated opening configured to receive and mount a printhead including the ink nozzle assembly;

the elongated opening configured to receive and mount a printhead including the ink nozzle assembly, where the elongated opening is in fluid communication with the at least one housing channel thereby providing a fluid path from the ink filter assembly to the ink nozzle assembly when mounted therein.

2. The system of claim 1, wherein a single membrane comprises the first membrane and the second membrane.

3. The system of claim 1, wherein the first and second membranes are configured to prevent particles of a predetermined size present in the first ink flow and the second ink flow from passing from the upper sections of the first elongated chamber and the second elongated chamber to the lower sections of the first elongated chamber and the second elongated chamber respectively.

4. A system, comprising:

an ink filter assembly comprising:

an upper portion including:

a first inlet channel configured to direct a first flow of ink in a first direction toward a first elongated chamber;

an upper section of the first elongated chamber extending from the first inlet channel to a first outlet channel;

a second inlet channel configured to direct a second flow of ink in a second opposite direction toward a second elongated chamber; and an upper section of the second elongated chamber extending from the second inlet channel to a second outlet channel;

a lower portion including:

the first outlet channel configured to receive the first flow of ink from the first elongated chamber and to direct the first flow of ink toward an ink nozzle assembly;

a lower section of the first elongated chamber extending from the first inlet channel to the first outlet channel;

the second outlet channel configured to receive the second flow of ink from the second elongated chamber and to direct the second flow of ink toward the ink nozzle assembly; and a lower section of the second elongated chamber extending from the second inlet channel to the second outlet channel; and a membrane positioned between the upper and lower portions of the assembly and orientated approximately parallel to longitudinal axes of the first and second elongated chambers, the membrane providing a permeable separator between the upper and lower sections of the first and second elongated chambers and the first and second flows of ink passing through the membrane;

wherein the ink filter assembly is configured to mount directly to a printhead housing including the ink nozzle assembly, such that the first and second elongated chambers are positioned directly above the printhead housing and the longitudinal axes of the first and second elongated chambers are substantially parallel to a longitudinal axis of the printhead housing and to a row comprising a plurality of nozzles included in the ink nozzle assembly and the printhead housing including:

an elongated body including a first opening to a first ink channel that aligns with the first outlet channel of the ink filter assembly and a second opening to a second ink channel that aligns with the second outlet channel of the ink filter assembly, the first and second ink channels terminating in at least one housing channel, where the ink filter assembly is mounted directly to the printhead housing and the first and second outlet channels are joined to the printhead housing with a fluid-tight connection;

the at least one housing channel being formed in the elongated body along a length of the elongated body, the at least one housing channel in fluid communication with the first and second outlet channels of the ink filter assembly via the first and second ink channels respectively, where the least at one housing channel is formed between an outer wall and an inner wall of the printhead housing, and the inner wall is configured to allow ink to flow between the at least one housing channel and an elongated opening configured to receive and mount a printhead including the ink nozzle assembly;

the elongated opening configured to receive and mount a printhead including the ink nozzle assembly, where the elongated opening is in fluid communication with the at least housing channel thereby providing a fluid path from the ink filter assembly to the ink nozzle assembly when mounted therein.

5. The system of claim 4, wherein the membrane is configured to prevent a particle of a predetermined size present in the first and second ink flows from passing from the upper sections of the first and second elongated chambers to the lower sections of the first and second elongated chambers.

6. The system of claim 5, wherein the membrane comprises a polyimide film including a plurality of openings of a predetermined size.

7. The system of claim 5, wherein the membrane comprises an electroformed metal substrate film including a plurality of openings of a predetermined size.

8. The system of claim 5, wherein the membrane comprises a chemically etched metal substrate film including a plurality of openings of a predetermined size.

9. The system of claim 5, wherein the membrane comprises a screen mesh film including a plurality of openings of a predetermined size.

10. A system, comprising:

an ink filter assembly comprising:

an upper portion including:

a first inlet channel configured to direct a first flow of ink toward a first elongated chamber;

an upper section of the first elongated chamber extending from the first inlet channel to a first outlet channel;

a second outlet channel configured to direct a second flow of ink out of the assembly; and an upper section of a second elongated chamber extending from the second outlet channel to a second inlet channel;

a lower portion including:

the first outlet channel configured to receive the first flow of ink from the first elongated chamber to direct the first flow of ink toward an ink nozzle assembly;

a lower section of the first elongated chamber extending from the first inlet channel to the first outlet channel;

the second inlet channel configured to receive the second flow of ink from the ink nozzle assembly and to direct the second flow of ink toward the second elongated chamber; and a lower section of the second elongated chamber extending from the second outlet channel to the second inlet channel; and a membrane positioned between the upper and lower portions of the assembly and orientated approximately parallel to longitudinal axes of the first and the second elongated chambers, the membrane providing a permeable separator between the upper and lower sections of the first and the second elongated chambers and orientated approximately parallel to longitudinal axes of the first and second elongated chambers, where the first and second flows of ink pass through the membrane;

wherein the ink filter assembly is configured to mount directly to a printhead housing including the ink nozzle assembly, such that the first and second elongated chambers are positioned directly above the printhead housing and the longitudinal axes of the first and second elongated chambers are substantially parallel to a longitudinal axis of the printhead housing and to a row comprising a plurality of nozzles included in the ink nozzle assembly; and the printhead housing including:

an elongated body including a first opening to a first ink channel that aligns with the first outlet channel of the ink filter assembly and a second opening to a second ink channel that aligns with the second inlet channel of the ink filter assembly, the first and second ink channels terminating in at least one housing channel, where the ink filter assembly is mounted directly to the printhead housing and the first outlet channel and second inlet channel are joined to the printhead housing with a fluid-tight connection;

the at least one housing channel being formed in the elongated body along a length of the elongated body, the at least one housing channel in fluid communication with the first outlet channel and the second inlet channel of the ink filter assembly via the first and second ink channels respectively, where the at least one housing channel is formed between an outer wall and an inner wall of the printhead housing, and the inner wall is configured to allow ink to flow between the at least one housing channel and an elongated opening configured to receive and mount a printhead including the ink nozzle assembly;

the elongated opening configured to receive and mount a printhead including the ink nozzle assembly, where the elongated opening is in fluid communication with the at least one housing channel thereby providing a fluid path from the ink filter assembly to the ink nozzle assembly when mounted therein.

11. The system of claim 10, wherein the membrane comprises:

a first segment that separates the upper and lower sections of the first elongated chamber, the first segment configured to prevent a particle of a predetermined size present in the first ink flow from passing from the upper section to the lower section of the first elongated chamber; and a second segment that separates the upper and lower sections of the second elongated chamber, the second segment configured to prevent a particle of a second predetermined size present in the second ink flow from passing from the lower section to the upper section of the second elongated chamber.

12. The system of claim 10, wherein:

the first inlet channel of the upper portion aligns with the second inlet channel of the lower portion and wherein the membrane provides an impermeable separator between the first inlet channel and the second inlet channel; and the second outlet channel of the upper portion aligns with the first outlet channel of the lower portion and wherein the membrane provides an impermeable separator between the second outlet channel and the first outlet channel.

13. A system, comprising:

an ink filter assembly mounted on a printhead housing, the ink filter assembly including:

an inlet channel at an end of the ink filter assembly and configured to direct a flow of ink in a direction toward an elongated chamber;

an outlet channel configured to direct the flow of ink from the elongated chamber to an ink nozzle assembly;

the elongated chamber extending from the inlet channel to the outlet channel; and a membrane providing a permeable separator between an upper section of the elongated chamber and a lower section of the elongated chamber, where the membrane is orientated in a plane approximately parallel to a longitudinal axis of the elongated chamber and the flow of ink passes through the membrane;

the printhead housing including:

an elongated body including at least one opening to an ink channel that aligns with the outlet channel of the ink filter assembly, the ink channel terminating in at least one housing channel, where the ink filter assembly is mounted directly to the printhead housing and the outlet channel is joined to the printhead housing with a fluid-tight connection;

the at least one housing channel being formed in the elongated body along a length of the elongated body, the at least one housing channel in fluid communication with the outlet channel of the ink filter assembly via the ink channel, where the at least one housing channel is formed between an outer wall and an inner wall of the printhead housing, and the inner wall is configured to allow ink to flow between the at least one housing channel and an elongated opening configured to receive and mount a printhead including the ink nozzle assembly;

the elongated opening configured to receive and mount a printhead including the ink nozzle assembly, where the elongated opening is in fluid communication with the at least one housing channel thereby providing a fluid path from the ink filter assembly to the ink nozzle assembly when mounted therein;

wherein, a central longitudinal axis of the ink filter assembly is substantially aligned with a central longitudinal axis of the elongated opening of the printhead housing, such that when the printhead including the ink nozzle assembly is mounted in the printhead housing the ink filter assembly is positioned directly above the printhead and a central longitudinal axis of the ink nozzle assembly is substantially aligned with the central longitudinal axis of the ink filter assembly.

14. The system of claim 13, wherein:

the ink filter assembly further comprises:

a second inlet channel located at a second opposite end of the ink filter assembly and configured to direct a second flow of ink in a second opposite direction toward a second elongated chamber;

a second outlet channel configured to direct the second flow of ink from the second elongated chamber to the ink nozzle assembly;

the second elongated chamber extending from the second inlet channel to the second outlet channel; and a second membrane providing a permeable separator between an upper section of the second elongated chamber and a lower section of the second elongated chamber, where the second membrane is orientated in a plane approximately parallel to a longitudinal axis of the second elongated chamber and the second flow of ink passes through the second membrane; and the printhead housing further comprises:

a second opening to a second ink channel that aligns with the second outlet channel of the ink filter assembly, the second ink channel terminating in the at least one housing channel, where the second outlet channel is joined to the printhead housing with a fluid-tight connection.

15. The system of claim 14, wherein a single membrane comprises the membrane and the second membrane.

16. The system of claim 13, wherein the membrane is configured to prevent a particle of a predetermined size present in the flow of ink from passing from the upper section of the elongated chamber to the lower section of the elongated chamber.

17. The system of claim 16, wherein the membrane comprises at least one of the following: a polyimide film including a plurality of openings of a predetermined size, an electroformed metal substrate film including a plurality of openings of a predetermined size, a chemically etched metal substrate film including a plurality of openings of a predetermined size, or a screen mesh film including a plurality of openings of a predetermined size.

18. The system of claim 13, wherein:

the ink filter assembly further comprises:

a second inlet channel located at a second opposite end of the ink filter assembly and configured to receive a second flow of ink from the ink nozzle assembly and to direct the second flow of ink toward a second elongated chamber;

a second outlet channel configured to direct the second flow of ink out of the ink filter assembly;

the second elongated chamber extending from the second inlet channel to the second outlet channel; and a second membrane providing a permeable separator between an upper section of the second elongated chamber and a lower section of the second elongated chamber, where the second membrane is orientated in a plane approximately parallel to a longitudinal axis of the second elongated chamber and the second flow of ink passes through the second membrane; and the printhead housing further comprises:

a second opening to a second ink channel that aligns with the second inlet channel of the ink filter assembly, the second ink channel terminating in the at least one housing channel, where the second inlet channel is joined to the printhead housing with a fluid-tight connection.

* * * * *

UNITED STATES PATENT AND TRADEMARK OFFICE

CERTIFICATE OF CORRECTION

PATENT NO. : 7,448,741 B2
APPLICATION NO. : 10/836456
DATED : November 11, 2008
INVENTOR(S) : Kevin Von Essen It is certified that error appears in the above-identified patent and that said Letters Patent is hereby corrected as shown below:

Column 11, line 17, after “one” delete “the”.

Column 12, line 16, after “assembly” insert --;--.

Column 12, line 43, after “least” insert --one--.

Signed and Sealed this

Third Day of February, 2009

John Doll

JOHN DOLL
*Acting Director of the United States Patent and Trademark Office*